United States Patent [19]

Prahl et al.

[11] Patent Number: 4,682,384

[45] Date of Patent: Jul. 28, 1987

[54] VACUUM GENERATING SYSTEM FOR HAND-HELD VACUUM CLEANER

[75] Inventors: Joseph M. Prahl; Werner W. Kochte, both of East Cleveland, Ohio

[73] Assignee: The Scott & Fetzer Company, Twinsburg, Ohio

[21] Appl. No.: 539,103

[22] Filed: Oct. 5, 1983

[51] Int. Cl.[4] ..... A47L 5/24

[52] U.S. Cl. ..... 15/344; 15/347

[58] Field of Search ..... 15/344, 347, 350, 351; 416/186 R

[56] References Cited

U.S. PATENT DOCUMENTS

| | | | |
|---|---|---|---|
| 1,120,130 | 12/1914 | Casella | 15/344 X |
| 1,954,416 | 4/1934 | Leathers | 15/344 |
| 2,974,346 | 3/1961 | Hahn | 15/344 |
| 2,997,959 | 8/1961 | Allen | 416/186 R |
| 3,513,500 | 5/1970 | Hori | 15/344 |
| 3,668,887 | 6/1972 | Riello | 416/186 X |
| 3,782,851 | 1/1974 | Hackbarth et al. | 416/186 X |
| 3,934,302 | 1/1976 | Mabuchi | 15/339 |
| 4,011,624 | 3/1977 | Proett | 15/344 |
| 4,209,875 | 7/1980 | Pugh et al. | 15/344 |
| 4,218,190 | 8/1980 | Nishikawa et al. | 416/186 R |
| 4,288,886 | 9/1981 | Siegler | 15/330 |
| 4,357,730 | 11/1982 | Lex | 15/344 |

FOREIGN PATENT DOCUMENTS

| | | | |
|---|---|---|---|
| 1147360 | 4/1963 | Fed. Rep. of Germany | 15/344 |
| 156568 | 9/1982 | Fed. Rep. of Germany | 15/344 |
| 3228491 | 2/1984 | Fed. Rep. of Germany | 15/344 |
| 1483157 | 6/1967 | France | 15/344 |
| 1483160 | 6/1967 | France | 15/344 |
| 592300 | 9/1947 | United Kingdom | 416/186 R |
| 2117977 | 10/1982 | United Kingdom | 15/344 |

OTHER PUBLICATIONS

*Fluid Flow,* 2d ed., Rolf H. Sabersky, Allan J. Acosta & Edward G. Hauptmann, McMillan, pp. 428, 429.

*Primary Examiner*—Philip R. Coe
*Assistant Examiner*—Frankie L. Stinson
*Attorney, Agent, or Firm*—Pearne, Gordon, McCoy & Granger

[57] ABSTRACT

The vacuum generating system for a hand-held vacuum cleaner comprises a fan or impeller having backwardly curved arcuate blades extending between preferably frusto-conical wall portions of front and rear fan shrouds. The front fan shroud is associated with the fan housing to provide a slip seal against vacuum loss around the sides of the fan. The centers of curvature of the arcuate blades are parallel to the central axis of the fan. Although the air flow passages defined by the blades and front and rear shrouds are of complex shapes, the fan may be manufactured economically. The air watts performance curve of the fan is desirably blunted or flattened without significant reduction of altitude or maximum height as compared to prior cleaners.

13 Claims, 8 Drawing Figures

VACUUM GENERATING SYSTEM FOR HAND-HELD VACUUM CLEANER

The present invention relates to vacuum generating systems for electric powered hand-held vacuum cleaners, and more particularly to an improved design of air impeller or fan and associated elements for a hand-held vacuum cleaner.

BACKGROUND OF THE INVENTION

Vacuum cleaners powered by house current have been almost universally used for home care for many years in industrialized countries. More recently, as motor designs improved in terms of reduction of size-to-power and weight-to-power ratios, hand-held vacuum cleaners have been proposed, as illustrated for example in U.S. Pat. No. 3,513,500. Still later, as it became economically practical to include rechargeable batteries in manufactured products, hand-held battery-operated vacuum cleaners were introduced, as illustrated for example in U.S. Pat. No. 4,209,875.

In all these designs, the provision of effective vacuuming action has, of course, been a prime consideration. An important goal is to achieve most effective utilization of power source and motor capabilities to deliver good vacuuming action over a range of flow rates. Flow rate for a small battery-operated cleaner may vary from say 5 to say 20 or 25 cubic feet per minute, depending on such factors as whether the surface being vacuumed is hard or napped, the angle at which the vacuum head or nozzle is applied to the surface, the change in angle as the tool is moved back and forth or from side to side, and similar factors incident to manipulation of the tool.

Lift or pressure drop, commonly measured in inches of water, has sometimes been regarded as a reliable indicator of vacuuming action, but this has come to be viewed as unsound since measurement of lift alone does not take flow rate into account. In any given device, the highest lift or pressure drop applies at the lowest flow rate where relatively little work is being done, work being the product of lift (pressure drop) and flow rate, usually expressed as air watts.

Since air watts is a measure of work being done, it is a good indicator of effective vacuuming action. Typically, for a given vacuum generating system, air watts increases to a maximum as flow rate increases and air watts then decreases as air flow continues to increase. In other words, when air flow is plotted on the x-axis of a graph and air watts on the y-axis, the curve peaks at an intermediate flow rate.

This peak is relatively sharp in the case of known battery-operated hand-held vacuum cleaners of the prior art. Since flow rate varies in actual use, it is highly desirable that the peak of the curve not be sharp, and that instead it be blunted or flattened, but without significant reduction of altitude or maximum height as compared to the battery-operated, hand-held vacuum cleaners of the prior art. With air watts thereby being maintained at high values across relatively wider ranges of flow rate, overall vacuuming action can be markedly improved.

SUMMARY OF THE INVENTION

The present invention accomplishes this object by providing a vacuum generating system that embodies a novel combination of flow guiding and backflow sealing elements in a small hand-held vacuum cleaners.

As indicated for the range of dimensionless values of specific speeds encountered, say 0.5 to 0.9, an air impeller or fan is employed that is of a mixed type, that is, partly centrifugal and partly axial. (For applicability of this criteria, see *Fluid Flow,* 2d ed., Rolf H. Sabersky, Allan J. Acosta & Edward G. Hauptmann, McMillan, p. 428.) Air is moved rearwardly for venting or exhausting in lateral directions, or combined lateral and rearward directions, rather than radially around the circumference of the vacuum cleaner through vanes intended to act as diffusers. The latter arrangement, used by at least one prior art vacuum, tends to scatter dirt and dust lying on the surface being vacuumed, thereby tending to defeat the overall objective of picking up dirt without scattering it. Furthermore, in such prior art vacuum, the vanes, which are intended to act as diffusers to convert kinetic energy of the air stream into pressure (so that fan exit pressure can be less than atmospheric, requiring the fan to supply less energy to the stream), act more like venturies due to their thickness, close spacing, and steep angling, so that fan discharge pressure is not significantly reduced.

The dimensions of the mixed type impeller or fan of the present invention are proportioned consistently with known pump design criteria in respect of inside radius, outside radius, and outlet width. See *Fluid Flow,* 2d, ed., supra, p. 429.

The mixed type air impeller or fan is associated with an intake funnel or venturi. The fan housing and a front shroud for the blades of the fan form a slip seal against backflow. The fan has backwardly curved blades positioned between the front shroud and a rear shroud, the axes of curvature of the blades being parallel to the axis of the fan. The configuration and relation of these parts for a good combination of performance and ease of manufacture are further described in the specification below.

The features of the invention are completely compatible with economic mass manufacturing methods. The invention is "forgiving," throughout reasonable ranges of manufacturing tolerances, in respect of the product's performance when put into service. Surprisingly, this is so despite the inherent disadvantages of the relatively small scale of the product—for example, leakage along a clearance of say 0.05 inch is much more significant across the small fan of a hand-held vacuum than it would be across a large impeller in an industrial pumping station or the like.

The invention will be more fully understood from the more detailed description below.

DESCRIPTION OF THE PREFERRED EMBODIMENT

Figure 1:
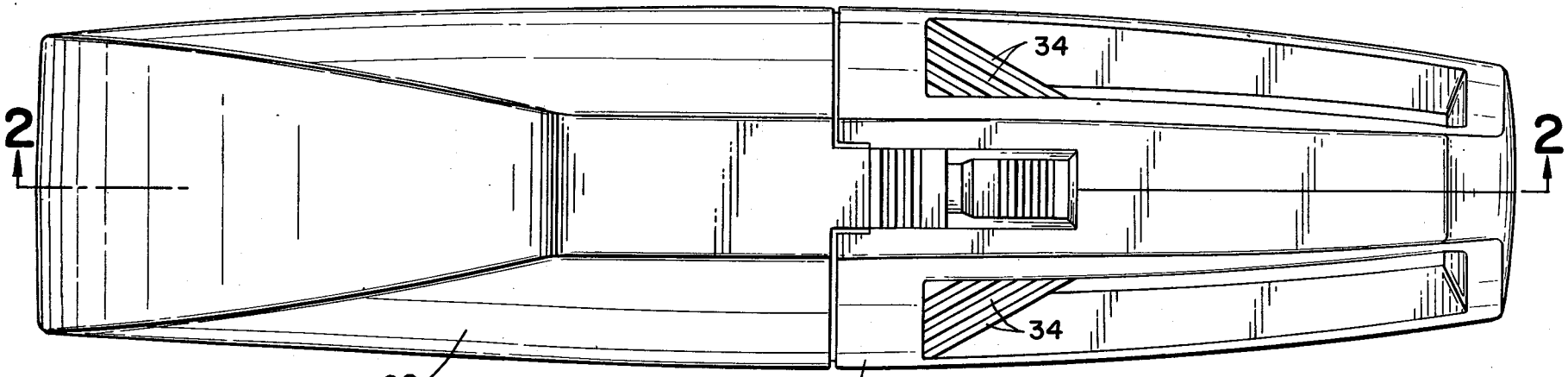
FIG. 1 is a plan view of a vacuum cleaner in which the invention is employed.

In the following description, numbers within parentheses refer to figure numbers of the drawings.

Shown in the drawings is a hand-held vacuum cleaner generally indicated at 10 (1, 2). The vacuum cleaner 10 is divided into a vacuum side 11 (2) and a pressure side 12 by fan housing means 14. An air impeller or fan generally indicated at 16 (2, 7, 8) is mounted in the fan housing means and is carried on a fan shaft 18 (2) extending from fan motor 20.

In the embodiment illustrated, the vacuum side 11 is defined in large part by a dust cup or housing 22 (1, 2) and the pressure side by exterior housing portions 24. The dust cup or housing 22 is releasably held on the end of the housing portions 24 by a latch 26 (2). A filter bag 28 is supported in the dust cup. Vacuum air is drawn into the intake mouth 30 and past the intake flap 32 which hinges inwardly to admit air and dirt. The air then passes through the filter bag, through a venturi throat generally indicated at 15, through the fan 16, through the adjacent region of the pressure side 12, and out through vent openings 34 (1, 2).

Figure 2:
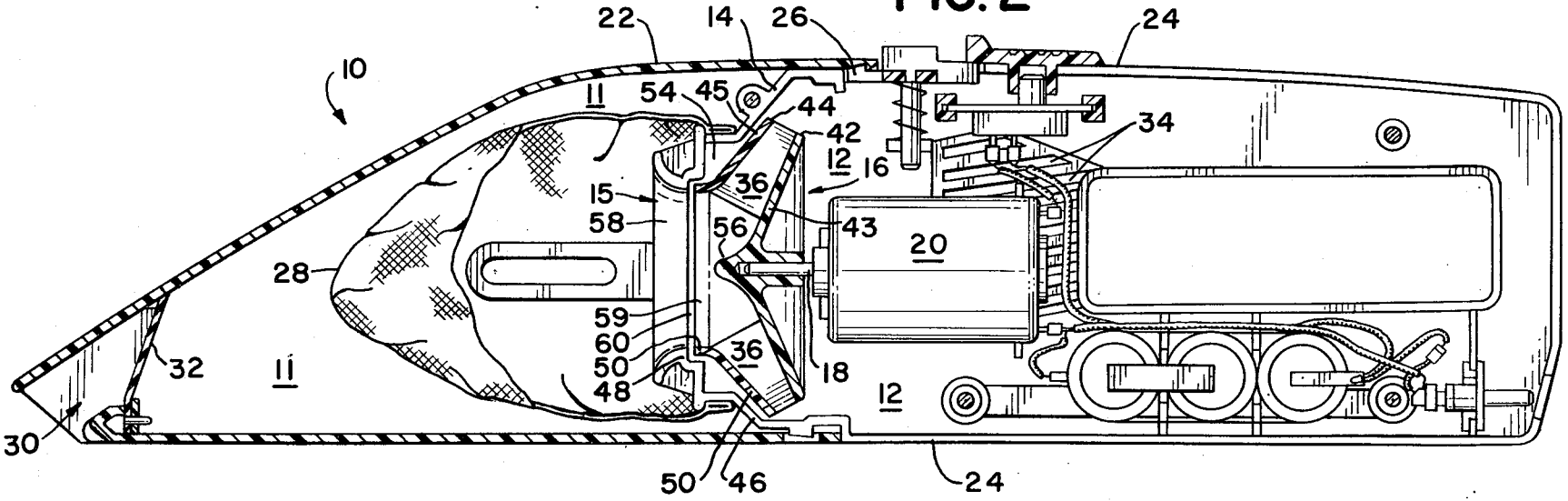
FIG. 2 is a sectional side elevation taken on the plane of line 2—2 in FIG. 1 and illustrating an embodiment of the invention.
Figure 4:
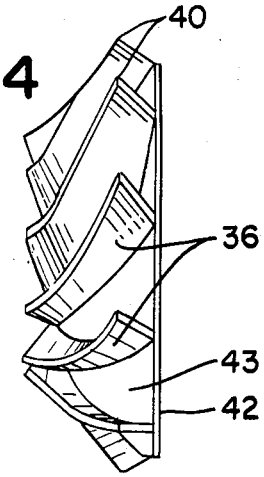
FIG. 4 is a side view of the parts seen in FIG. 3.
Figure 5:
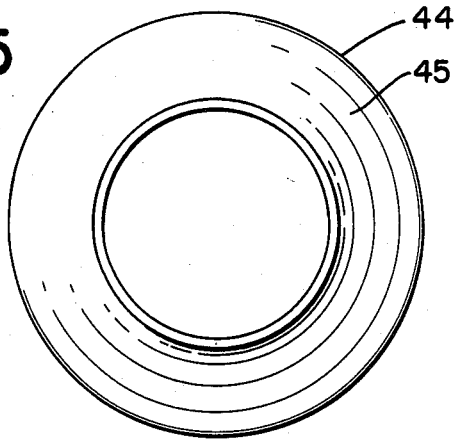
FIG. 5 is a front view of the front shroud of the fan.
Figure 6:
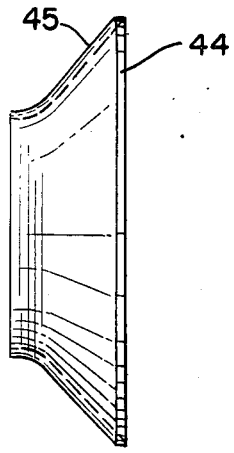
FIG. 6 is a side view of the part seen in FIG. 5.
Figure 7:
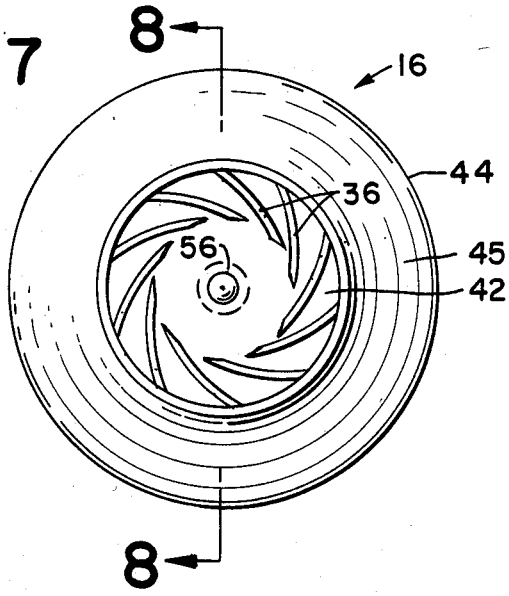
FIG. 7 is a front view of the assembled fan.

As seen in FIG. 2, the front of the fan 16 communicates with the vacuum side 11, and the rear with the pressure side 12. The fan may be molded in two parts shown in front view respectively in FIGS. 3 and 5, and in side view in FIGS. 4 and 6. These parts may then be ultrasonically welded together to provide the assembly seen in front view in FIG. 7 and in side section in FIG. 8.

Figure 3:
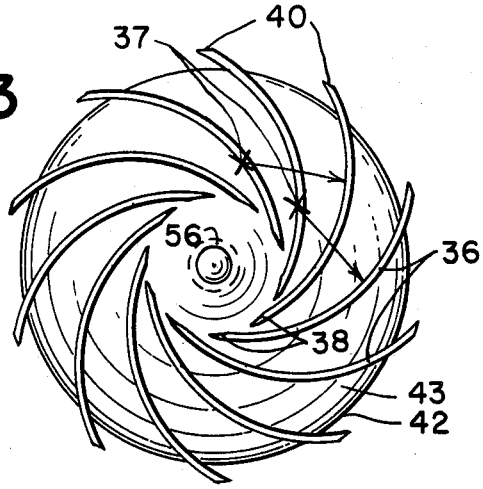
FIG. 3 is a front view of the blades and rear shroud of the fan or impeller, which may be molded as a single piece.
Figure 8:
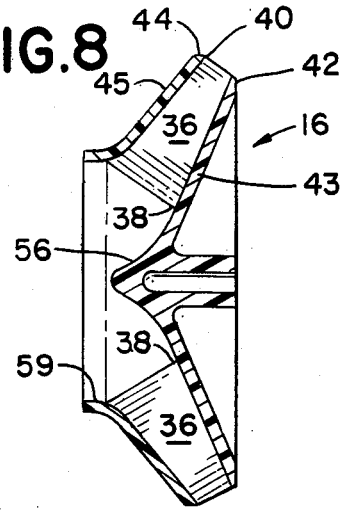
FIG. 8 is a section taken on the plane of line 8—8 in FIG. 7.

As best seen in FIG. 3, the blades 36 (2–4, 7, 8) of the fan are arcuate in shape, each having an axis of curvature 37 (two are located by "X"s in FIG. 3) parallel to the central axis of the fan. The blades 36 are backwardly curved, that is, as they extend radially outwardly, they curve back away from the direction of rotation, which is clockwise as viewed in FIG. 3. The blades extend from an inner imaginary circle, at the radially innermost blade extremities seen in FIGS. 2, 3, 7 and 8, to an outer imaginary circle at the radially outermost extremities seen in FIGS. 2–4 and 8. The blades 36 are positioned between a rear shroud 42 (2–4, 7, 8) with which they are integrally molded, and a front shroud 44 (2, 5-8) to which they are welded. The blades thereby intersect each shroud. As illustrated, the blades are four-cornered. Such inner imaginary circle is at the inner rear corners 38 (2, 8) of the blades, and such outer imaginary circle is at the outer front corners 40 (3, 4, 8) of the blades. As best seen in FIG. 8, the outer front corners 40 are rearward of the inner rear corners 38. Although the fan or impeller 16 is of the mixed type, partly centrifugal and partly axial, and the air flow passages defined by the blades 36 and shrouds 42, 44 are of complex shape, the parallelism of the axes of curvature of the blades to the central axis of the fan, and therefore to each other, simplifies manufacture by allowing the complex subassembly illustrated in FIGS. 3 and 4 to be readily stripped from a mold cavity opened at a single parting line.

As best seen in FIG. 3, each axis of curvature is spaced from its corresponding blade a distance greater than the radial distance between the inner and outer imaginary circles previously mentioned, and less than the radius of the outer imaginary circle. In other words, the radii of curvature of the blades lie between these limits. Each blade as shown has a single center of curvature, so that in transverse cross section each blade is circular in the sense that it lies on a circle. However, several centers or a continuous series of instantaneous centers may be provided to produce more complex arcuate shapes having compound curvature. However, for such more complex arcuate shapes, the plural axes of curvature should be spaced from the corresponding blade as specified, so that the blade's radii of curvature will generally be between the limits mentioned.

As best seen in FIGS. 2 and 8, the rear shroud 42 includes an annular, slanting wall portion 43 (2–4, 8), preferably frustoconical as shown, that is relatively shallowly angled rearwardly as it extends radially outwardly from the inner imaginary circle at the corners 38 to an outer edge that is radially inward of the outer imaginary circle at the corners 40. The front shroud 44 includes an annular slanting wall portion 45 (2, 5–8), also preferably frustoconical as shown, that is relatively shallowly angled rearwardly as it extends radially outwardly from a location radially outward of the inner imaginary circle to an outer edge coincident with the outer imaginary circle.

Annularly continuous portions 46, 48 (2) of the fan housing means 14 are positioned in closely spaced facing relation with corresponding portions 50, 52 of the front shroud 44 to provide slip seal means which counteracts by a centrifugal pumping action the tendency of air to leak back around the sides of the fan to the vacuum side. In the embodiment illustrated, the interface between the fan housing and front shroud is interrupted by a small annular plenum 54 as an incident to provision of a mounting for the filter bag 28, but this does not significantly reduce slip seal action. With other bag mounting arrangements, the plenum 54 can be eleminated so that the slip seal extends continuously from back to front along the outside of the front shroud.

A central spinner 56 (2, 3, 7, 8) is faired into the annular sloping wall portion 43 of the rear shroud 42. Venturi throat means is faired into the annular sloping wall portion 45 of the front shroud 44. The upstream portion of the venturi throat means is constituted by the stationary element 58 (2). An additional portion 59 (2, 8) of the venturi throat means may be part of the rotating structure associated with the fan 16. The stationary portion of the venturi throat means is separated from the rotating structure by the circular gap 60 (2) which occurs at the narrowest part of the venturi throat means and which interrupts the otherwise generally smoothly continuous throat surface constituted by the elements 58 and 59.

With the present invention, the air watts vs. air flow curve is desirably blunted or flattened without significant reduction of altitude or maximum height as compared to battery-operated, hand-held vacuum cleaners of the prior art. With air watts thereby maintained at high values across relatively wider ranges of flow rate, overall vacuuming action is markedly improved. The "forgiving" nature of the invention in respect of manufacturing tolerances contributes to economy of manufacture. The mixed type of fan or impeller (partly centrifugal and partly axial) lends itself to efficient operation while venting laterally, or laterally and rearwardly as through the vents 34, without scattering dirt and dust on the surface being vacuumed.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a hand-held vacuum cleaner, a vacuum generating system comprising fan housing means dividing said cleaner into a vacuum side and a pressure side, a fan mounted in said fan housing means, the front of said fan communicating with said vacuum side, the rear of said fan communicating with said pressure side, said fan having backwardly curved arcuate blades that extend from an inner imaginary circle at their radially innermost extremities outwardly to an outer imaginary circle at their radially outermost extremities, each blade having an axis or axes of curvature that is or are parallel to the central axis of the fan, said axes of curvature being spaced from their corresponding blades a distance or distances greater than the radial distance between said inner and outer imaginary circles and less than the radius of said outer imaginary circle, each of said blades intersecting at its opposite side edges respectively with (1) a rear shroud that includes an annular sloping wall portion that is relatively shallowly angled rearwardly as it extends radially outwardly from said inner imaginary circle to an outer edge that is radially inward of said outer imaginary circle and (2) a front shroud that includes an annular sloping wall portion that is relatively more sharply angled rearwardly as it extends radially outwardly from a location radially outward of said inner imaginary circle to an outer edge that is coincident with said outer imaginary circle, annularly continuous portions of said fan housing means being positioned in closely spaced facing relation with corresponding portions of said front shroud including a substantial part of said sloping wall portion to provide slip seal means, the rearward end of said slip seal means being radially outward of its forward end such that it provides a centrifugal pumping action to counteract air leakage around the fan from the pressure side to the vacuum side, central spinner means faired into said annular sloping wall portion of said rear shroud, venturi throat means faired into the radially inner portion of said annular sloping wall portion of said front shroud so as to avoid abrupt angular changes in the surfaces encountered by air flowing into the fan, an upstream portion of the venturi throat means being stationary and separated from rotating structure associated with said fan by a circular gap, said upstream portion and associated rotating structure being of generally the same inside diameter adjacent said gap and smoothly increasing in diameter axially forwardly and axially rearwardly respectively, of said gap, said gap being served by said slip seal means which counteracts the tendency for air to leak from the pressure side of the fan back around the fan and through said gap.

2. A device as in claim 1, said arcuate blades being four-cornered, said inner imaginary circle being at the inner rear corners of the blades, said outer imaginary circle being at the outer front corners of the blades, said outer front corners being rearward of said inner rear corners.

3. A device as in claim 2, said annular sloping wall portions of said rear and front shrouds being frustoconical.

4. A device as in claim 1, an additional relatively small portion of said venturi throat means being constituted by the most upstream portion of said rotating structure.

5. A device as in claim 1, said gap occurring at the narrowest part of said venturi throat means.

6. A device as in claim 1, said arcuate blades each having a single axis of curvature so that the transverse cross section of each blade is circular.

7. A device as in claim 1, said arcuate blades each having a single axis of curvature so that the transverse cross section of each blade is circular.

8. A device as in claim 7, said arcuate blades being four-cornered, said inner imaginary circle being at the inner rear corners of the blades, said outer imaginary circle being at the outer front corners of the blades, said outer front corners being rearward of said inner rear corners.

9. A hand-held vacuum cleaner set forth in claim 1, wherein said outer edge of said front shroud is substantially spaced axially forwardly and radially outwardly of the outer edge of said rear shroud, the fan blades and shrouds being adapted to direct substantially all of the air passing therethrough in directions having both substantial radial and substantial axial components.

10. A hand-held vacuum cleaner which includes a vacuum generating system comprising fan housing means dividing said cleaner into a vacuum side and a pressure side, a fan mounted in said fan housing means, the front of said fan communicating with said vacuum side, the rear of said fan communicating with said pressure side, said fan having four-cornered, backwardly curved arcuate blades that extend from an inner imaginary circle at their inner rear corners outwardly to an outer imaginary circle at their outer front corners, said outer front corners being rearward of said inner rear corners, each blade having an axis or axes of curvature that is or are parallel to the central axis of the fan, said axes of curvature being spaced from their corresponding blades a distance or distances greater than the radial distance between said inner and outer imaginary circles and less than the radius of said outer imaginary circle, each of said blades intersecting at its opposite side edges respectively with (1) a rear shroud that includes a frustoconical wall portion that is relatively shallowly angled rearwardly as it extends radially outwardly from said inner imaginary circle to an outer edge that is radially inward of said outer imaginary circle and (2) a front shroud that includes a frustoconical wall portion that is relatively more sharply angled rearwardly as it extends radially outwardly from a location radially outward of said inner imaginary circle to an outer edge that is coincident with said outer imaginary circle, annularly continuous portions of said fan housing means being positioned in closely spaced facing relation with corresponding portions of said front shroud including a substantial part of said frustoconical wall portion to provide slip seal means, the rearward end of said slip seal means being radially outward of its forward end such that it provides a centrifugal pumping action to counteract air leakage around the fan from the pressure side to the vacuum side, said side edges of said blades that are at said intersections with said rear shroud extending radially inwardly further but radially outwardly less far than said side edges of said blades that are at said intersections with said front shroud, central spinner means faired into said frustoconical wall portion of said rear shroud, venturi throat means faired into the radially inner portion of said frustoconical wall portion of said front shroud, the upstream portion of said venturi throat means being stationary, the stationary portion of said venturi throat means being separated from rotating structure associated with said fan by a circular gap which interrupts an otherwise generally smoothly continuous throat surface free of abrupt angular change, partly constituted by said stationary portion and partly by said rotating structure, the stationary portion and rotating structure, constituting said smoothly continuous throat surface on respective sides of said gap, having substantially the same diameter and having tangents that are substantially mutually parallel and smoothly increasing in diameter axially forwardly and axially rearwardly, respectively of said gap, an additional relatively small portion of said venturi throat means being constituted by the most upstream portion of said rotating structure, said gap occurring at the narrowest part of said venturi throat means.

11. A vacuum cleaner as set forth in claim 10, wherein one of the stationary portion and rotating structure elements constituting the throat surface interrupted by said gap has a generally cylindrical surface telescoped axially with the other of such elements adjacent the gap in such a manner that the minimum radial spacing between such elements adjacent the gap is independent of limited variation in the axial size of the gap.

12. A hand-held vacuum cleaner which includes a vacuum generating system comprising fan housing means dividing said cleaner into a vacuum side and a pressure side, a motor mounted in the pressure side of the fan housing and including a shaft, a fan mounted on the motor shaft forwardly of the motor in said fan housing means, the front of said fan communicating with said vacuum side, the rear of said fan communicating with said pressure side, said fan having four-cornered, backwardly curved arcuate blades that extend from an inner imaginary circle at their inner rear corners outwardly to an outer imaginary circle at their outer front corners, said outer front corners being rearward of said inner rear corners, each blade having an axis or axes of curvature that is or are parallel to the central axis of the fan, said axes of curvature being spaced from their corresponding blades a distance or distances greater than the radial distance between said inner and outer imaginary circles and less than the radius of said outer imaginary circle, each of said blades intersecting at its opposite side edges respectively with (1) a rear shroud that includes a frustoconical wall portion that is relatively shallowly angled rearwardly as it extends radially outwardly from said inner imaginary circle to an outer edge that is radially inward of said outer imaginary circle and (2) a front shroud that includes a frustoconical wall portion that is relatively more sharply angled rearwardly as it extends radially outwardly from a location radially outward of said inner imaginary circle to an outer edge that is coincident with said outer imaginary circle and is substantially spaced axially forwardly and radially outwardly of the outer edge of the rear shroud, annularly continuous portions of said fan housing means being positioned in closely spaced facing relation with corresponding portions of said front shroud including a substantial part of said frustoconical wall portion to provide slip seal means, said side edges of said blades that are at said intersections with said rear shroud extending radially inwardly further but radially outwardly less far than said side edges of said blades that are at said intersections with said front shroud, central spinner means faired into said frustoconical wall portion of said rear shroud, venturi throat means faired into the radially inner portion of said frustoconical wall portion of said front shroud, the upstream portion of said venturi throat means being stationary, the stationary portion of said venturi throat means being separated from rotating structure associated with said fan by a circular gap which interrupts an otherwise generally smoothly continuous throat surface partly constituted by said stationary portion and partly by said rotating structure, an additional relatively small portion of said venturi throat means being constituted by the most upstream portion of said rotating structure, said gap occurring at the narrowest part of said venturi throat means and the immediately adjacent upstream and downstream portions of the throat means increasing in diameter away from the gap, the fan blades and shrouds being adapted to direct substantially all of the air passing therethrough in flow directions having both substantial radial and substantial axial components to promote efficient air flow radially and axially around the motor, the pressure side of the fan housing including external air vent openings in zones axially coincident and lateral of the motor, said air vent openings being adapted to exhaust air in directions having both lateral and rearward components.

13. A hand-held vacuum cleaner which includes a vacuum generating system comprising fan housing means dividing said cleaner into a vacuum side and a pressure side, a motor mounted in the pressure side of the fan housing and including a shaft, a fan mounted on the motor shaft forwardly of the motor in said fan housing means, the front of said fan communicating with said vacuum side, the rear of said fan communicating with said pressure side, said fan having blades each with opposite side edges intersecting respectively with a rear shroud and a front shroud, annularly continuous portions of said fan housing means being positioned in closely spaced facing relation with corresponding portions of said front shroud to provide slip seal means, venturi throat means faired into a radially inner portion of said front shroud, the upstream portion of said venturi throat means being stationary and separated from rotating structure associated with said fan by a circular gap which interrupts an otherwise generally smoothly continuous throat surface partly constituted by said stationary portion and partly by said rotating structure, one of the stationary portion and rotating structure elements constituting the throat surface interrupted by said gap having a generally cylindrical surface telescoped axially with the other of such elements adjacent the gap in such a manner that the minimum radial spacing between such elements adjacent the gap is independent of limited variation in the axial size of the gap, said gap occurring at the narrowest part of said venturi throat means and the immediately adjacent upstream and downstream portions of the throat means increasing in diameter away from the gap.

* * * * *